United States Patent [19]

Amarantos

[11] 3,999,333

[45] Dec. 28, 1976

[54] INFLATABLE ENCLOSURE

[76] Inventor: John G. Amarantos, 6114 Gardenia, Long Beach, Calif. 90805

[22] Filed: Nov. 14, 1975

[21] Appl. No.: 631,859

[52] U.S. Cl. ..... 52/2; 52/80
[51] Int. Cl.[2] ..... E04B 1/345
[58] Field of Search ..... 135/1 R; 52/2

[56] References Cited

UNITED STATES PATENTS

| | | | |
|---|---|---|---|
| 2,812,769 | 11/1957 | Schaefer et al. | 52/2 |
| 2,895,490 | 7/1959 | Dimond | 52/2 X |
| 2,938,526 | 5/1960 | Harrison et al. | 52/2 |
| 3,338,001 | 8/1967 | Fraser | 52/2 |
| 3,899,853 | 8/1975 | Wertman | 135/1 R X |
| 3,909,992 | 10/1975 | Stachiw | 52/2 |

*Primary Examiner*—Werner H. Schroeder
*Assistant Examiner*—Conrad L. Berman
*Attorney, Agent, or Firm*—William C. Babcock

[57] ABSTRACT

An inflatable enclosure that includes a tubular header that is anchored to the ground or to the floor, which header has a number of spaced valved apertures therein through which a pressurized gas may flow outwardly but not inwardly. First and second continuous pliable sheets have their peripheral edge portions bonded to opposite sides of the header. A number of inflatable pliable tubes are disposed side-by-side between the sheets and bonded thereto, with first ends of the tubes in communication with the valved apertures, and second end of the tubes in communication with normally closed valved means. A pressurized gas inlet is provided in the header. When pressurized gas is discharged into the header it flows through the one way valved apertures into the tubes to inflate the latter, with the inflated tubes and sheets cooperating to define an enclosure that extends upwardly above the header. The tubes and sheets when the valve means is placed in an open position collapse into a compact configuration.

1 Claim, 10 Drawing Figures

FIG. 1
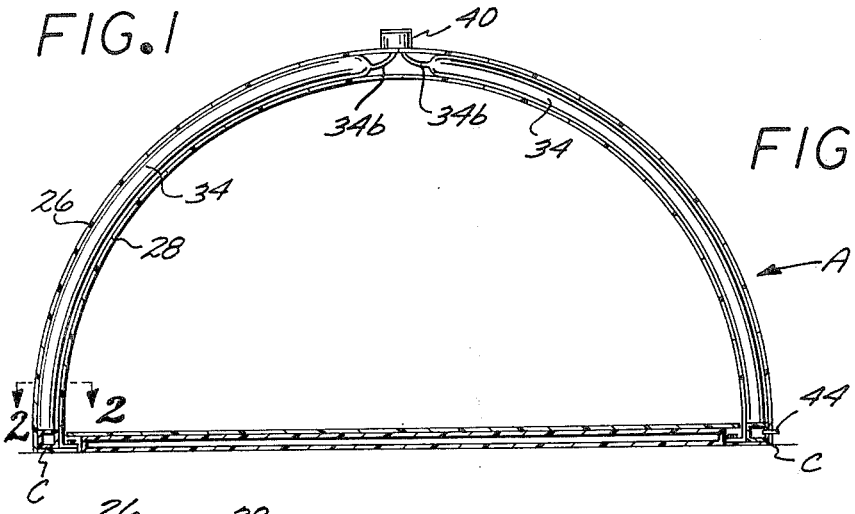
FIG. 8
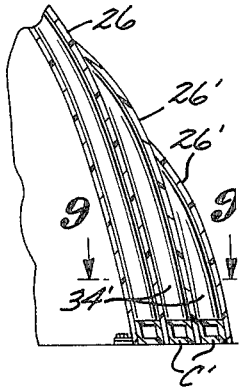
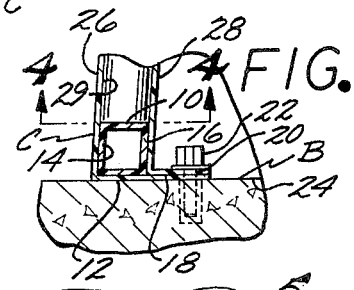
FIG. 3
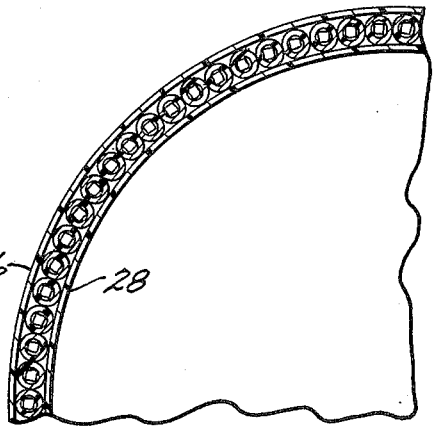
FIG. 2
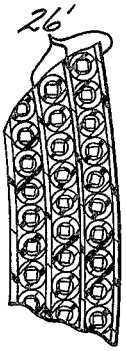
FIG. 9
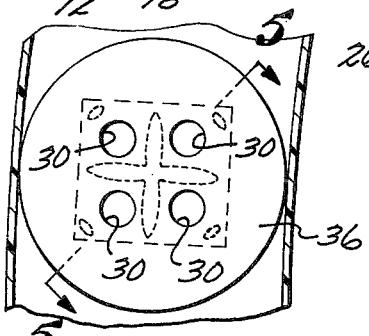
FIG. 4
FIG. 5
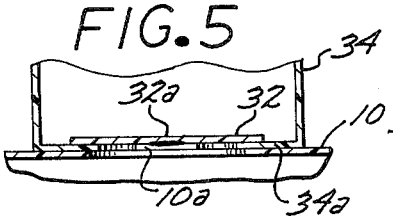
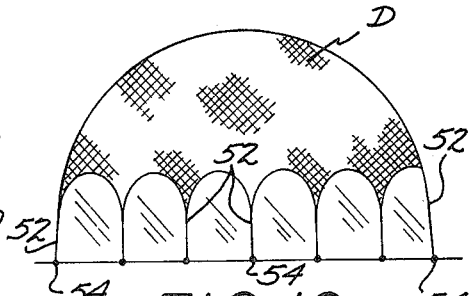
FIG. 10
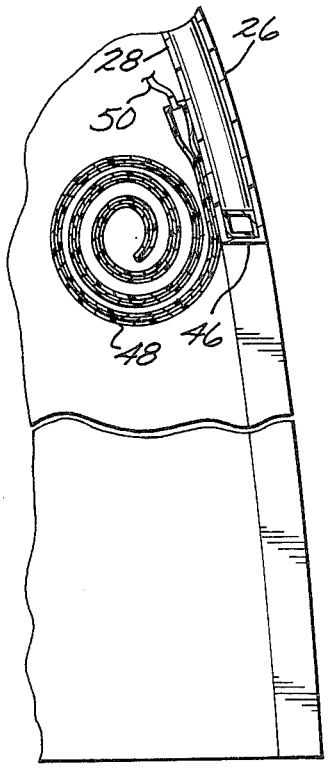
FIG. 6
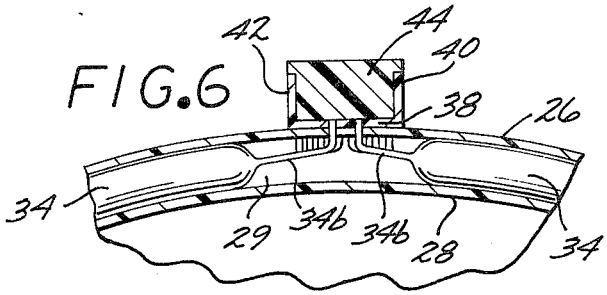
FIG. 7

INFLATABLE ENCLOSURE

BACKGROUND OF THE INVENTION

1. Field of the Invention

Inflatable Structure

2. Description of the Prior Art

The desirability of having a collapsible enclosure that may be easily and simply disposed in a sheltering position for equipment and personnel has long been recognized. Tents have been used for this purpose, but have the operational disadvantage that they require the erection of a rigid frame structure, and in a strong wind may be blown down.

The primary object of the present invention is to provide an enclosure that will serve the same function as a tent, but will eliminate the objection of a rigid frame that must be erected and dismantled, but may also be blown down when subjected to a strong wind.

Another object of the invention is to supply an enclosure that occupies a minimum of space when not in use, that is relatively inexpensive and is of simple structure, may be inflated by a pressurized gas to define an enclosure for sheltering personnel and equipment, and one that will temporarily deform when subjected to a strong wind but will not blow down.

SUMMARY OF THE INVENTION

An enclosure defining device that includes an endless hollow header that may be anchored to a floor or the ground and has spaced first and second sheets secured thereto. A number of tubes are bonded to the interior surfaces of the first and second sheets, with first ends of the tubes in communication with valved apertures in the header, and second ends of the tubes in communication with the apertured bottom of a cup shaped member. The cup shaped member is removably and sealingly closed by a plug. When pressurized gas is discharged into the header it flows to the tubes to inflate the latter. The inflated tubes have sufficient rigidity to support the first and second sheets in an arched position above the header and the floor area within the interior of the header. By removing the plug from the cup shaped member, pressurized gas from the tubes may flow to the ambient atmosphere, and the tubes and first and second sheets collapse into a compact mass. The first and second walls have radially aligned openings therein that provide a doorway for entry and exit into and out of the enclosure. The doorway may be closed by an inflatable door. Tie downs secured to the floor may be used to maintain a protective canopy over the inflated enclosure defining device.

BRIEF DESCRIPTION OF THE DRAWING

FIG. 1 is a vertical cross-sectional view of the invention in an inflated shelter-providing position;

FIG. 2 is a fragmentary transverse cross-sectional view of the device taken on the line 2—2 of FIG. 1;

FIG. 3 is a fragmentary vertical cross-sectional view of the header and anchor portion of the device that is adjacent the floor surface;

FIG. 4 is a transverse cross-sectional view of the device taken on the line 4—4 of FIG. 3 illustrating one of the valves used on the header;

FIG. 5 is a vertical cross-sectional view of one of the valves taken on the line 5—5 of FIG. 4;

FIG. 6 is a fragmentary vertical cross-sectional view of the device illustrating the pressurized gas release at the top of the enclosure shown in FIG. 1;

FIG. 7 is a fragmentary horizontal cross-sectional view of the device illustrating an inflatable door that may be used to close an opening in the side portion of the enclosure when the latter is inflated;

FIG. 8 is a fragmentary vertical cross-sectional view of the device illustrating an alternate structure therefor;

FIG. 9 is a fragmentary horizontal cross-sectional view of the alternate structure shown in FIG. 8 taken on line 9—9 of the latter; and FIG. 10 is a side elevational view of an anchored canopy used in protecting the inflated structure.

DESCRIPTION OF THE PREFERRED EMBODIMENTS

The invention A is shown in FIG. 1 in an inflated state and as such provides either temporary or permanent shelter over a floor or ground area B situated within the interior of an endless hollow header C that is illustrated as being circular in shape. The header C is illustrated as being of transverse cross-section and defined by a flat upper wall 10, lower wall 12, and first and second side walls 14 and 16 that extend therebetween. A number of outwardly extending clips 18 are secured in spaced relationship on header C, with each clip having an opening 20 therein through which a bolt 22 extends to engage the concrete defining a floor 24.

The first and second side walls 14 and 16 have free marginal edge portions of first and second pliable sheets 26 and 28 secured by glue or the like thereto, which first and second sheets define a space 29 therebetween. Upper wall 10 has a number of circumferentially spaced groups of apertures 30 formed therein, with each group of apertures being disposed about a portion **10*a* of the upper wall 10**.

A number of pliable valve plates 32 have the center portions **32*a* thereof bonded to upper wall portions 10*a*, with the valve plates of sufficient size as to extend over the apertures 30 most adjacent thereto. A number of elongate resilient tubes 34 are provides that have first ends 34*a* and second end portions 34*b*, which second end portions are of lesser transverse cross-section than the balance of the tubes. The tubes 34 are disposed side-by-side in the space 29 and bonded to the interior surfaces of the first and second sheets 26 and 28. Each of the tubes 34 has the first end 34*a* thereof bonded to the upper wall 10 of header C, and the interior of the tube in communication with one of the valves 36, which valve defined by valve plate 32 and a group of apertures 30**.

The second end portions **34*b* are in communication with an apertured bottom 38 that has a continuous side wall 40 extending upwardly therefrom to define a cup shaped member 42 best seen in FIG. 1 and FIG. 6. The cup shaped member 42 has a plug 44 removably mounted therein. Pressurized air may be discharged into header C through a conventional inlet 44** shown in FIG. 1.

When pressurized air is discharged into header C through inlet 44, the air flows through the valves 36 to inflate tubes 34, with the tubes then bowing upwardly to support the first and second sheets in the arched configuration illustrated in FIG. 1. Air cannot flow from the tubes back to the header C due to the differential in areas of the valve plates 32 exposed to air in the tubes 34 and that in the header C.

The first and second sheets 26 and 28 may cooperate to define a door opening 46 shown in FIG. 7. A spring loaded, double walled door 48 is adjacently disposed to opening 46, with the door when inflated by pressurized air through an inlet 50 moving from the helix configuration shown in FIG. 7 to a flat configuration that spans the door opening.

Should it be desired to reinforce the invention, the first sheet 26 may have additional sheets 26' placed in spaced relationship therewith to support additional tubes 34' through headers C'.

If desired, additional stability may be imported to the invention A by extending a canopy D thereover as shown in FIG. 10 which has tie-downs 52 extending downwardly therefrom to anchors 54.

The use and operation of the invention has been explained previously in detail and need not be repeated.

I claim:

1. An enclosure that may be inflated to define a shelter and said enclosure when deflated assuming a compact configuration, said enclosure including:

a. an endless hollow header capable of being supported on a substantially flat surface, said header defining an area of substantial magnitude within the interior thereof, said header including upper and lower walls that are connected by inner and outer side wall, said upper wall having a plurality of spaced groups of apertures therein, with each of said groups of apertures being disposed about a first portion of said upper wall;

b. a plurality of pliable valve plates, with each of said plates extending over one of said groups of apertures and one of said first portions;

c. first means for bonding each of said plates to one of said first portions;

d. first and second laterally spaced pliable sheets that have free marginal edge portions thereof bonded to said first and second side walls, said first and second sheets defining a space therebetween;

e. a plurality of pliable tubes having first free ends and second ends of restricted transverse cross-section, said tubes disposed in said space and bonded to said first and second sheets;

f. second means for bonding said first ends of said pliable tubes to said upper wall of said header, with each of said tubes capable of having the interior thereof communicate with one of said groups of apertures;

g. third means for discharging a pressurized gas into said header to inflate said tubes into upwardly extending positions where said tubes and sheets cooperate to define an enclosure situated above said header;

h. a cup shaped member sealingly secured to openings in substantially the center of said first and second sheets, said member defined by a continuous side wall and a bottom in which a plurality of spaced openings are formed that communicate with said second ends of said tubes; and i. a plug that removably and sealingly engages said side wall, with said plug when removed from said cup permitting said enclosure to deflate by pressurized gas flowing therefrom.

* * * * *